US007143617B2

(12) United States Patent
Futamura et al.

(10) Patent No.: US 7,143,617 B2
(45) Date of Patent: Dec. 5, 2006

(54) PRESS

(75) Inventors: Shoji Futamura, Atsugi (JP); Keizo Unno, Atsugi (JP)

(73) Assignee: Institute of Technology Precision Electrical Discharge Work's (JP)

( * ) Notice: Subject to any disclaimer, the term of this patent is extended or adjusted under 35 U.S.C. 154(b) by 392 days.

(21) Appl. No.: 10/483,284

(22) PCT Filed: Feb. 13, 2003

(86) PCT No.: PCT/JP03/01471

§ 371 (c)(1),
(2), (4) Date: Jan. 8, 2004

(87) PCT Pub. No.: WO03/068490

PCT Pub. Date: Aug. 21, 2003

(65) Prior Publication Data

US 2004/0170718 A1 Sep. 2, 2004

(30) Foreign Application Priority Data

Feb. 14, 2002 (JP) ..... 2002-036541

(51) Int. Cl.
*B21C 55/00* (2006.01)

(52) U.S. Cl. ..... 72/20.1; 72/21.3; 72/30.1; 72/453.08; 72/454; 100/46; 100/257; 100/348

(58) Field of Classification Search ..... 72/20.1, 72/21.3, 30.1, 31.01, 453.08, 453.03, 453.02, 72/453.09, 453.04, 454; 100/46, 348, 231, 100/257, 288, 289, 270, 271

See application file for complete search history.

(56) References Cited

U.S. PATENT DOCUMENTS

| | | | | |
|---|---|---|---|---|
| 4,076,780 | A * | 2/1978 | Ditto | 264/40.5 |
| 4,269,580 | A * | 5/1981 | Wright | 425/150 |
| 4,784,058 | A * | 11/1988 | Nakagawa et al. | 100/46 |
| 6,595,122 | B1 * | 7/2003 | Mukai et al. | 100/46 |
| 6,792,788 | B1 * | 9/2004 | Futamura et al. | 72/453.03 |
| 6,810,704 | B1 * | 11/2004 | Futamura et al. | 72/17.2 |
| 7,007,529 | B1 * | 3/2006 | Futamura et al. | 72/20.1 |

FOREIGN PATENT DOCUMENTS

| | | | |
|---|---|---|---|
| JP | 10-277791 | | 10/1998 |
| JP | 11-254191 | | 9/1999 |
| JP | 2000-15499 | | 1/2000 |
| JP | 2000-79500 | | 3/2000 |
| WO | WO 93/05954 | * | 4/1993 |

* cited by examiner

*Primary Examiner*—David B. Jones
(74) *Attorney, Agent, or Firm*—McGlew & Tuttle

(57) ABSTRACT

A press forming machines includes displacement measuring means for measuring a displacement between a slide plate and a reference plate. Control means measures a positional displacement of each of the driving sources by using the displacement measuring means in each of a plurality of operating steps during the molding operation, detects a desired displacement position of the entire slide plate, extracts control data including a correction amount to maintain the entire slide plate at the desired displacement position, the correction amount corresponding to a change in load on each of the driving sources, stores the control data in the memory, supplies the control data to the driving sources, and separately drives the driving sources. Since an actual molding operation can be performed using control data generated in a trial molding operation, the cycle time of the actual molding can be shortened.

15 Claims, 9 Drawing Sheets

P
P0
P1
P2
P3
t1
t2
t3
t

V
t1
t2
t3
t

ΔV
t1
t2
t3
t

ΔL
t1
t2
t3
t
tA
tB
tC

PRESS

TECHNICAL FIELD

The present invention relates to a press forming machine used for molding a metal plate and so on and particularly to a press forming machine capable of maintaining a slide plate on which a movable mold is mounted at a desired position relative to a fixed mold.

BACKGROUND ART

Press forming machines are used for punching press, drawing molding, die forging, injection molding, and so on. A press forming machine generally has one mold as a fixed mold and the other mold as a movable mold. A vertical press forming machine has a lower support stand, a plurality of columns supported by the lower support stand, an upper support plate held by the columns, and a slide plate which can reciprocate between the lower support stand and the upper support plate along the columns and has a molding space between the slide plate and the lower support stand. In the molding space, a fixed mold is provided on the lower support stand, a movable mold is provided on the lower surface of the slide plate, and a work piece is molded between the fixed mold and the movable mold. The slide plate is generally formed into a plane and is vertically moved by a driving mechanism. It is desirable to carry out molding while the movable mold is kept on a desired position relative to the fixed mold, for example, while the movable mold is kept horizontally and moved. Thus, the slide plate is moved while being kept horizontally, and the columns are formed with rigidity and a large thickness to prevent the slide plate from being inclined during molding. However, in some cases, distortion occurs on the slide plate and so on and inclination occurs due to a clearance between sliding parts. Thus, it has been necessary to correct the mold to compensate for the distortion and inclination.

The driving mechanism is mounted on the upper support plate, a drive shaft extends from the mechanism, and the tip of the shaft is engaged to the slide plate. A servomotor or a hydraulic cylinder is used as a driving source. In the case of a motor, the rotation of the motor is transformed to a vertical motion by a crankshaft and a cam and the rotation of the shaft is transformed to a vertical motion by a ball screw.

In some shapes of the work piece to be subjected to press forming, an offset load may occur on a mold, and a fixed mold and a movable mold or a slide plate may not stay horizontal to each other. Regarding a plurality of driving sources provided for driving the slide plate, the following proposal has been made: the slide plate is kept in a horizontal position by controlling the driving sources so as to maintain the synchronization among the plurality of driving sources.

However, since a work piece formed by press forming has a complicated shape such as a three-dimensional shape, force applied to the slide plate during molding is changed in the progress of the molding. Besides, a position where force is applied is shifted during the molding.

For example, FIGS. 9(A), 9(B), and 9(C) schematically show the state of reaction force applied to the slide plate when an oil pan for an automobile is formed by press molding. In these drawings, a slide plate 40 is indicated as x-y coordinates. For example, when molding is started, a cope initially reaches a drain of the oil pan and the drain is formed. Hence, force occurring thereon is applied to a fourth quadrant of the x-y coordinates. An oil dish is formed as the molding proceeds. Thus, large forces w2 and w3 are received from a second quadrant and a third quadrant of the coordinates. Force w1, which is originally applied, is reduced at this moment, and large force w4 on a first quadrant is added. Hence, composite force W is applied to the third quadrant. As the molding proceeds, the forces w2 to w4 decrease, force w5 is added, and composite force is applied to the right of y axis substantially on x axis.

The above application of forces and composite force, the magnitude of force, and the above changes in force may vary depending upon the shapes of the work piece and a traveling speed of the mold. The position and magnitude of the composite force, which is applied on the slide plate, is generally changed as the press forming proceeds.

As described above, the position where composite force is applied moves not only along a straight line but also in a biaxial direction, that is, on a plane when a work piece having a three-dimensional shape is molded.

When composite vertical force exerted to the slide plate is applied to the center, rotation moment for inclining the slide plate is not applied to the slide plate. Since the position where force is applied is moved as described above, the position and magnitude of rotation moment applied to the slide plate are also changed. Therefore, deformation occurring on the press forming machine is changed as the press forming proceeds. The deformation includes the extension and bending of the columns of the press forming machine and distortion of the slide plate, the upper support plate, and the fixed support plate during press forming.

In this manner, the application of load is changed as the press forming proceeds, and the extension and deformation on the parts of the press forming machine are also changed.

Conventionally, in order to minimize the extension and deformation on the parts of the press forming machine, that is, for example, in order to reduce the inclination and distortion of the slide plate, the slide plate increases in thickness with rigidity and the columns increase in thickness to reduce a gap between the slide plate and the columns. And then, when a plurality of driving sources is used to press the slide plate, a main driving source is driven according to a desired control style to move down the slide plate, and the other slave driving sources are driven while being controlled according to the descend of the main driving source.

The controlling method using the main driving source and the slave driving sources is a method for evenly pressing the entire of the slide plate (e.g., while being forcefully kept in a horizontal position) while the rigidity of the slide plate is made sufficiently large. This method is effective for a large press forming machine.

However, when distortion on the parts of the slide plate and other parts of the machine needs to be considered, in the method for performing driving while controlling the slave driving sources according to the main driving source, in view of the above-mentioned distortion, it is extremely difficult to allow the slave driving sources to follow the main driving source such that the distortion is eliminated. Further, even when the above-mentioned method is possible, in view of control exercised by a computer when the main driving source and the slave driving sources are controlled, a processing amount of the computer is extremely large, so that it is necessary to install a high-speed computer.

An object of the present invention is to provide a press forming machine which can separately drive driving sources so as to always maintain a movable mold at a desired position relative to a fixed mold when press forming proceeds.

Another object of the present invention is to provide a press forming machine whereby when the same kind of work piece is repeatedly subjected to press forming, control data corresponding to driving sources is previously stored in a memory of control means in each of a plurality of operating steps, and the driving sources are driven separately in an asynchronous manner according to the stored control data during press forming so as to perform desired molding.

As a result, molding time can be shortened in the case of repeated molding. Even when a CPU of the control means is relatively slow in processing speed, the driving sources can be controlled, thereby reducing molding time.

DISCLOSURE OF THE INVENTION

A press forming machine of the present invention comprises:

a lower support stand, an upper support plate held by a plurality of columns supported by the lower support stand, a slide plate which can reciprocate between the lower support stand and the upper support plate and has a molding space between the slide plate and the lower support stand, a plurality of driving sources, and control means for controlling driving each of the driving sources.

Each drive shaft of the driving sources is engaged to the upper surface of the slide plate to make a displacement of the slide plate. The control means changes the position of each of the driving sources in each of a plurality of operating steps during a molding operation. The control means comprises a memory which stores control data for each of the driving sources, the control data including a correction amount corresponding to a change in load on each of the driving sources, and means which supplies control data stored in the memory for each of the driving sources and separately drives the driving sources. The correction amount is preferably supplied when a load on each of the driving sources is changed or for a predetermined period from when a load is changed.

The driving sources are preferably located such that pressure applied by the plurality of driving sources is evenly distributed on the slide plate. Further, it is preferable to use driving sources which can generate an equal pressure in every unit of control data. When the same number of driving signal pulses is inputted to the driving sources, it is preferable for driving sources to exert equal driving forces, that is, each has similar specifications.

Or in the press forming machine, engaging parts corresponding to the driving sources are provided on the slide plate, displacement measuring means, which measure a displacement according to a positional change of the slide plate, are disposed near the engaging parts, and control means is provided for controlling driving of the driving sources. The control means preferably comprises means which measures a positional displacement of each of the driving sources by using the displacement measuring means in each of a plurality of operating steps during the molding operation, measures a positional displacement of each of the driving sources, the positional displacement corresponding to a change in load on each of the driving sources, detects a desired displacement position of the entire slide plate, extracts or generates control data corresponding to the driving sources to maintain the entire slide plate at the desired displacement position, stores the control data in the memory, supplies the control data to the driving sources, and separately drives the driving sources. When it is preferable to drive the slide plate while maintaining the slide plate in a horizontal position, control data corresponding to the driving sources can be extracted and generated such that the slide plate is horizontal in each step, as a desired displacement position of the entire slide plate.

When actual molding is repeated after trial molding, the control means may comprise means which supplies to the driving sources control data corresponding to the driving sources in each of a plurality of operating steps during the actual molding operation and which separately drives the driving sources, the control data being obtained so as to maintain the entire slide plate in a desired position in each of a plurality of operating steps during the trial molding operation.

The control means preferably comprises means which detects a desirable displacement position of the entire slide plate by using the displacement measuring means in each of a plurality of operating steps during the trial molding operation and extracts the control data corresponding to the driving sources to maintain the entire slide plate at the desired displacement position.

BRIEF DESCRIPTION OF THE DRAWINGS

FIG. 8 is a diagram showing the detail of a reference plate in the press forming machine of FIG. 7;

BEST MODE FOR CARRYING OUT THE INVENTION

Figure 1:
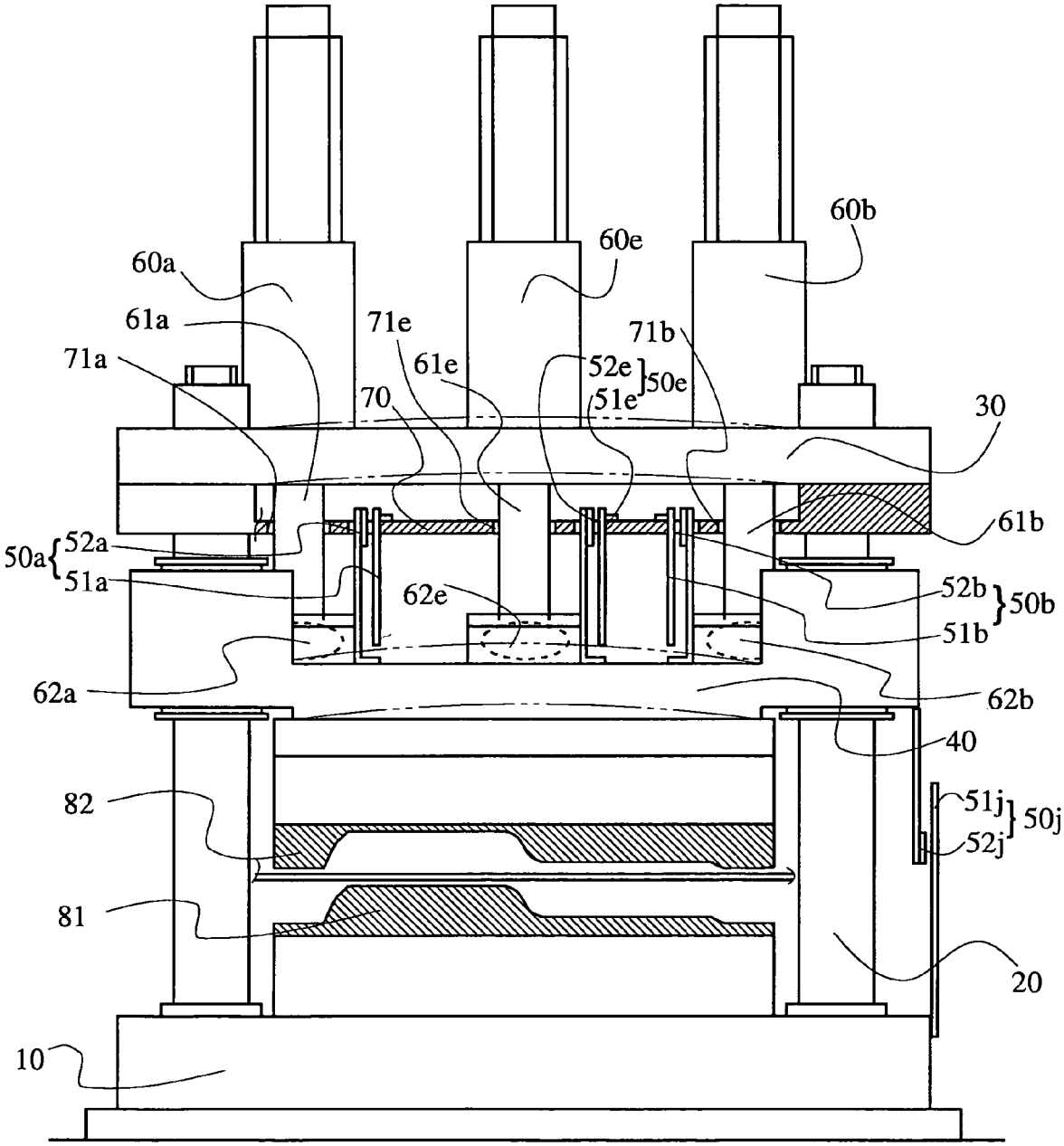
FIG. 1 is a front view showing an example of a press forming machine which can be used for the present invention.
Figure 2:
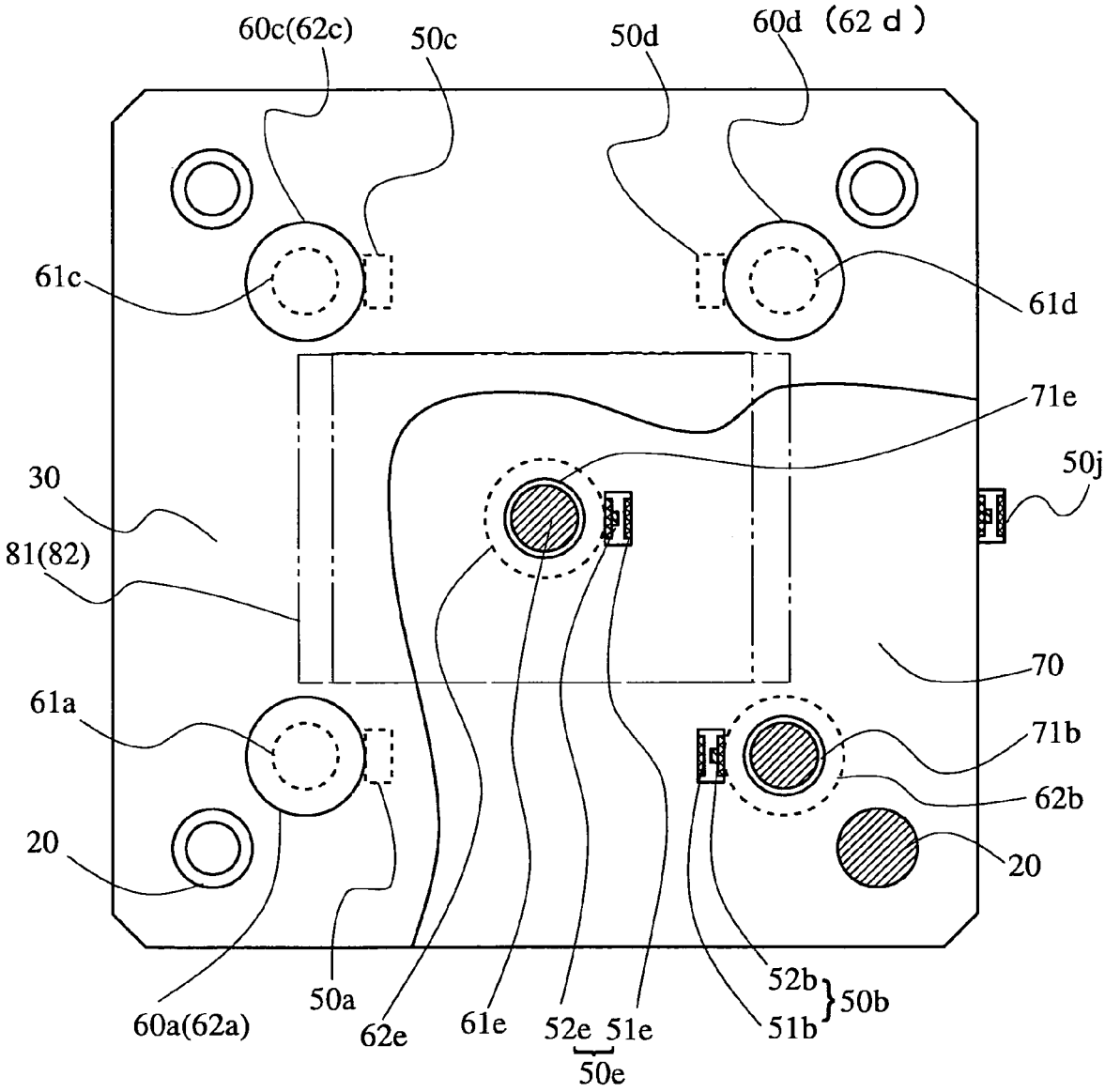
FIG. 2 is a plan view showing the press forming machine of FIG. 1 with an upper support plate being partially removed.

First, referring to FIGS. 1 and 2, the following will discuss an example of a press forming machine used for the present invention. FIG. 1 is a front view of the press forming machine, and FIG. 2 is a plan view of the press forming machine. In FIG. 2, an upper support plate is partially removed. In the press forming machine, a lower support stand 10 is fixed on a floor, and an upper support plate 30 is held by columns 20 set up on the lower support stand. A slide plate 40, which can reciprocate along the columns 20, is provided between the lower support stand 10 and the upper support plate 30, and a molding space is provided between the slide plate and the lower support stand. In the molding space, a fixed mold (drag) 81 for pressing is provided on the lower support stand, and a movable mold (cope) 82 corresponding to the fixed mold is provided on the lower surface of the slide plate. For example, a plate to mold is placed between the molds to carry out molding. A displacement measuring means 50*j* is provided between the slide plate and the lower support stand to measure the position of the slide plate 40 relative to the lower support stand 10. Although FIGS. 1 and 2 show only a single displacement measuring means 50*j*, a plurality of displacement measuring means may be provided. As the displacement measuring means, means is applicable which has a magnetic scale 51*j* with magnetic scales and a magnetic sensor 52*j* such as a magnetic head, which is opposed to the magnetic scale with a small gap. The magnetic sensor 52*j* is moved relative to the fixed magnetic scale 51*j* so as to measure an absolute position, a displacement speed, and so on. Such displacement measuring means has been well known as a linear magnetic encoder to a person skilled in the art, so that further explanation is omitted. As the displacement measuring means, a means for measuring a position by light or an acoustic wave is also applicable.

Five sources are provided as driving sources 60*a*, 60*b*, 60*c*, 60*d* and 60*e*, each combining a servomotor and a speed reducing mechanism on the upper support plate 30. Drive shafts 61*a*, 61*b*, 61*c*, 61*d* and 61*e*, which extend downward from the driving sources, pass through through-holes 71*a*, 71*b*, . . . , 71*e*, which are formed on a reference plate 70, and are engaged to engaging parts 62*a*, 62*b*, . . . , 62*e* on the upper surface of the slide plate 40. For example, ball screws are placed on the drive shafts to transform the rotation into vertical motion, and the slide plate is vertically moved by the rotation of the servomotor. A driving mechanism is constituted by the driving sources, the drive shafts and the engaging parts.

It is preferable to locate the driving sources such that pressure applied to the plurality of driving sources 60*a*, 60*b*, 60*c*, 60*d* and 60*e* is evenly distributed to the slide plate. Further, it is preferable that the driving sources generate equal pressures, that is, the outputs of the driving sources are equal.

As shown in the plan view of FIG. 2, the engaging parts 62*a*, 62*b*, 62*c* and 62*d* surround a molding region of the molding space, and the engaging part 61*e* is located, for example, at the center of the molding region. Moreover, each of displacement measuring means 50*a*, 50*b*, 50*c*, 50*d* and 50*e* is provided near each of the engaging parts 62*a*, 62*b*, 62*c*, 62*d* and 62*e*. As the displacement measuring means 50*a*, 50*b*, 50*c*, 50*d* and 50*e*, means similar to the displacement measuring means 50*j* is applicable. The means 50*j* is located on the right of the press forming machine. Magnetic scales 51*a*, 51*b*, . . . , 51*e* of the displacement measuring means 50*a*, 50*b*, 50*c*, 50*d* and 50*e* are provided on the reference plate 70, and magnetic sensors 52*a*, 52*b*, . . . , 52*e* are supported by columns placed on the engaging parts 62*a*, 62*b*, 62*c*, 62*d* and 62*e*. Here, the reference plate 70 is held at the same position regardless of the position of the slide plate 40. Thus, when the slide plate 40 is driven by the action of the driving sources 60*a*, 60*b*, 60*c*, 60*d* and 60*e*, the displacements of the engaging parts can be measured by the displacement measuring means 50*a*, 50*b*, 50*c*, 50*d* and 50*e*.

In FIG. 1, the reference plate 70 is provided under the upper support plate 30 via an interval and is fixed over the columns 20, and the reference plate 70 has the through holes 71*a*, 71*b*, . . . , 71*e* with sufficient diameters on the parts having the drive shafts 61*a*, 61*b*, . . . , 61*e*, so that the reference plate is not affected by deformation on the drive shafts and the slide plate. In the case of some shapes of the work piece, the upper support plate 30 and the slide plate 40 may be deformed as indicated by a chain double-dashed line of FIG. 1 as molding proceeds. However, since the reference plate 70 is supported only by the columns 20 on the both sides, the reference plate maintains a reference position regardless of deformation on the slide plate and the upper support plate.

Figure 3:
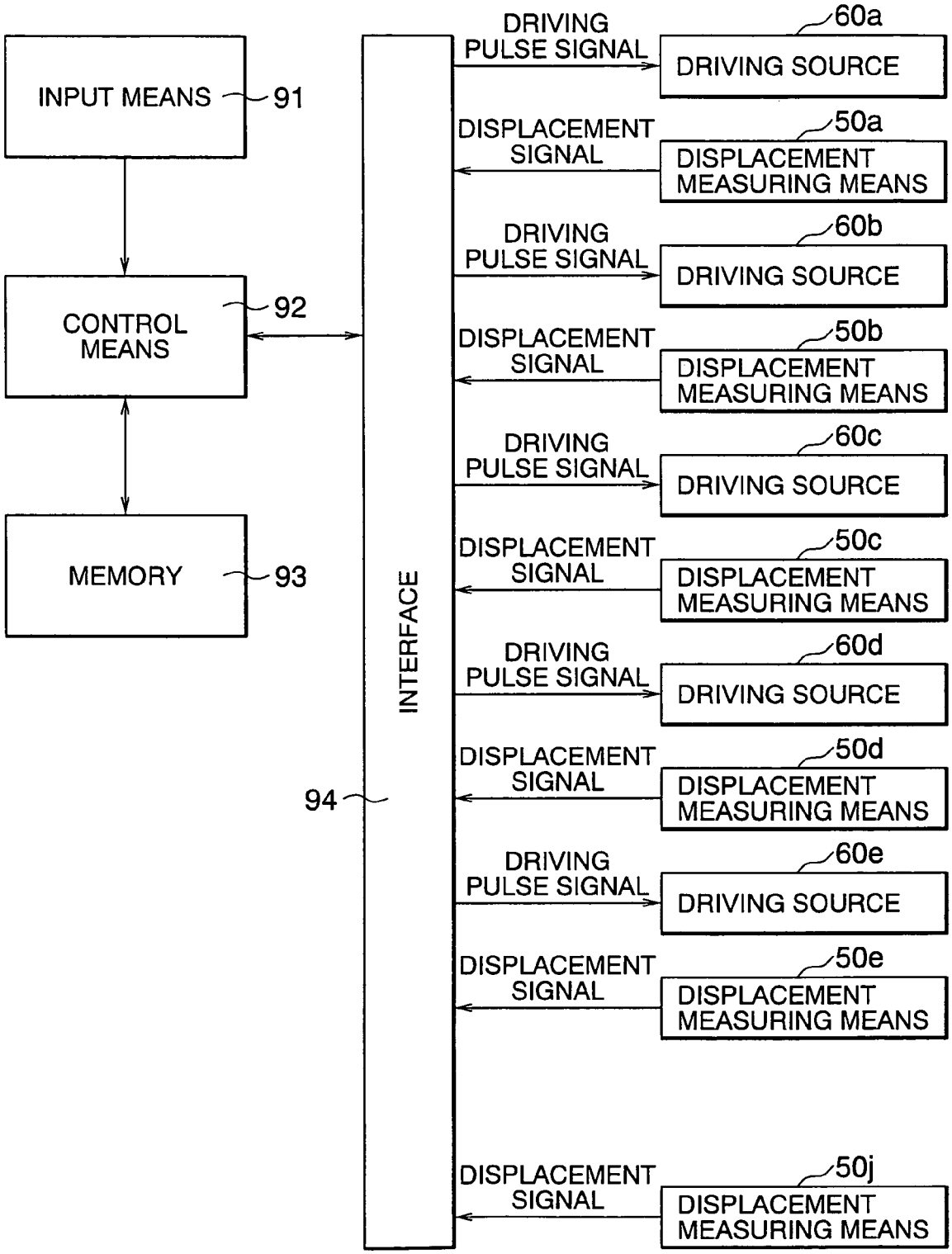
FIG. 3 is a diagram showing the control system of the press forming machine according to the present invention.

FIG. 3 shows a control system of the press forming machine. Before molding, for example, a product name to be molded, a molding pressure, and molding time are previously inputted to control means 92 from input means 91 as necessary. The control means 92 has a CPU, and driving pulse signals are transmitted to the driving sources 60*a*, 60*b*, 60*c*, 60*d* and 60*e* from the control means 92 via an interface 94, and molding is carried out by driving the driving sources. A displacement signal of the slide plate is transmitted to the control means 92 from the displacement measuring means 50*a*, 50*b*, 50*c*, 50*d*, 50*e* and 50*j*.

Figure 9A:
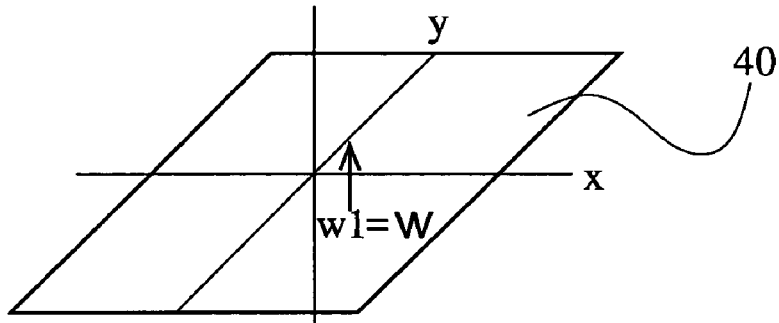
FIGS. 9(A), 9(B), and 9(C) are diagrams schematically showing reaction force applied to the slide plate of a press forming machine with the passage of time.
Figure 9B:
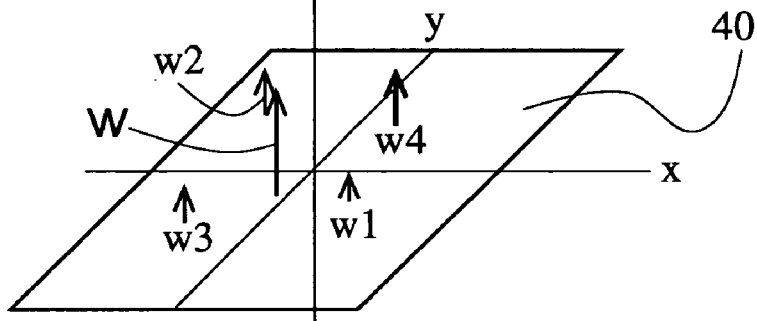
Figure 9C:
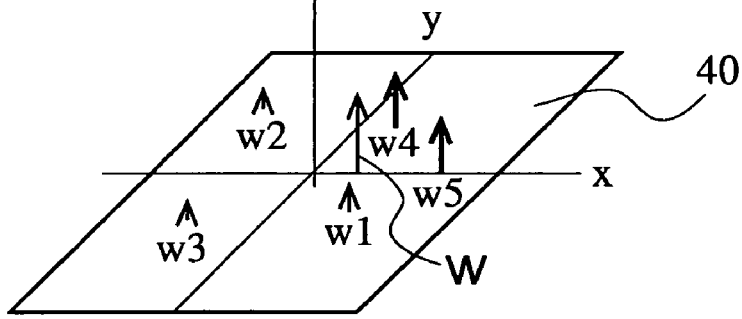

As molding proceeds, force applied to the slide plate is changed as described in FIG. 9. Loads applied to the driving sources 60*a*, 60*b*, 60*c*, 60*d* and 60*e* are varied according to the force change. The fixed mold and the parts of the movable mold that correspond to the driving sources become irregular in positional relationship. Some parts quickly press down the slide plate 40, or other parts slowly press down the slide plate 40. The advance and delay in the slide plate are measured by the displacement measuring means 50*a*, 50*b*, 50*c*, 50*d*, 50*e* and 50*j* and are transmitted to the control means 92 so as to adjust a driving pulse signal transmitted to the driving sources 60*a*, 60*b*, 60*c*, 60*d* and 60*e* such that displacements of the displacement measurement means 50*a*, 50*b*, 50*c*, 50*d*, 50*e* and 50*j* are set at desirable values, that is, the slide plate is made horizontal on the parts of the engaging parts.

In this manner, when a work piece is molded, control data, which includes driving pulse signals supplied to the driving sources, is stored in a memory from the control means in each of a plurality of operating steps. The plurality of operating steps may include elapsed time from the start of press forming, a descending distance of the slide plate, or the order of molding from the start of press forming. For example, when the slide plate descends, time until the movable mold starts to press the molded plate or a moving distance until the movable mold starts to press the molded plate is designated as a first operating step. Thereafter, when the molding is started, since control data largely changes, short elapsed time periods or short descending distances (small displacements) are each designated as operating steps.

Next, control in molding will be discussed. At this moment, driving pulse signals are supplied to the driving sources, the slide plate is moved downward, and molding is started. When a movable mold 82 has a molded plate with a fixed mold 81 and makes contact with a most protruding part of the mold to start molding of the molded plate, the reaction force is applied to the slide plate. The same numbers of driving pulse signals are supplied to each of the driving sources. However, when the application of reaction force is started, the application of loads to the driving sources becomes uneven. Thus, the driving source receiving a larger load has a larger resistance, thereby reducing a descending displacement speed. Conversely, a descending displacement speed does not change or a displacement may relatively increase on the part of the slide plate that corresponds to the driving source on a part having a lighter load. Such displacements are measured by the displacement measuring means disposed near the parts of the slide plate, and measured values are sent to the control means 92. The control means 92 adjusts the numbers of driving pulse signals supplied to each of the driving sources so as to return the slide plate substantially to a horizontal position. The adjusted driving pulse signals are stored in a memory 93 for each of the driving sources, together with displacements or time in each of the operating steps.

Figure 4:
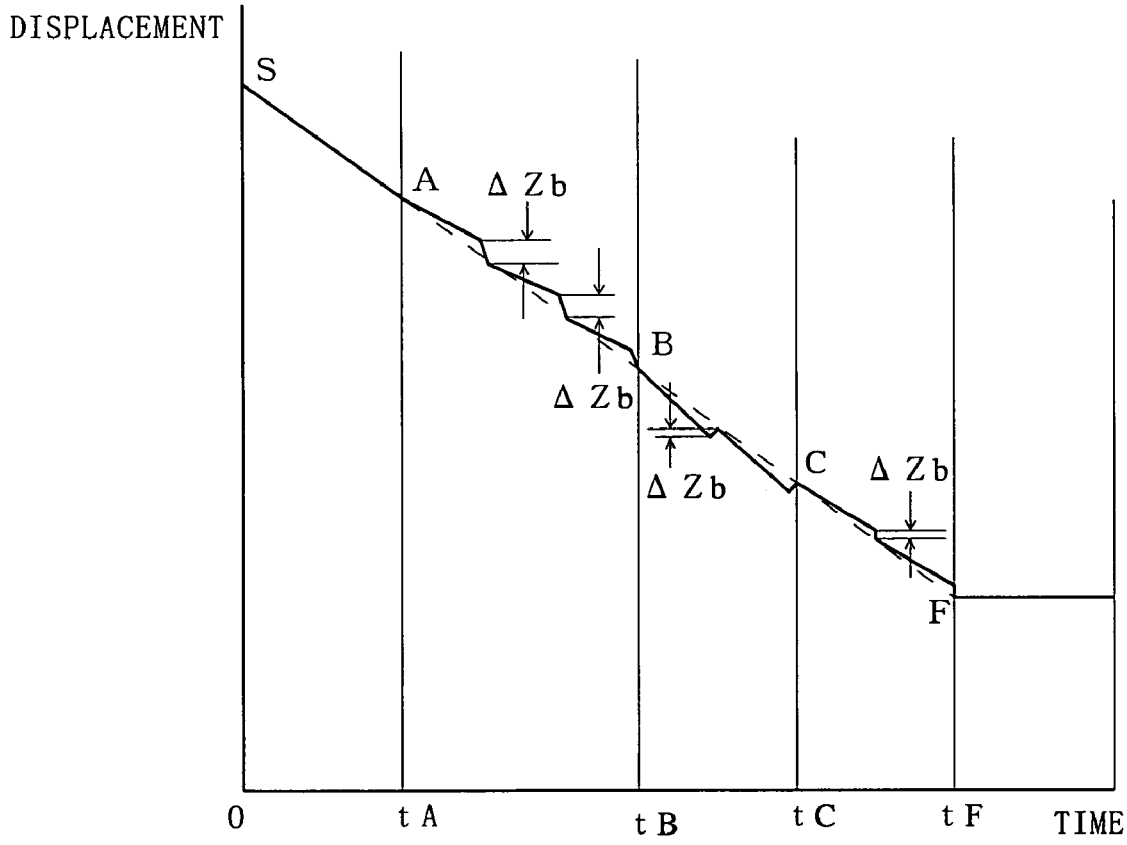
FIG. 4 is a graph showing displacements of a slide plate of the press forming machine relative to time.

FIG. 4 is an explanatory drawing, in which the position of the slide plate, for example, a positional change near the driving sources is indicated on the vertical axis and molding time is indicated on the lateral axis. In FIG. 3, the start of molding is denoted as S and the end of molding is denoted as F. A dotted line connecting S and F is an ideal molding line (command value), which is a traveling line approximately corresponding to command values of the slide plate entirely shifted downward. A measured value of the displacement measuring means 50*b* near the driving source 60*b* is indicated by a thick line. Since the slide plate descends horizontally until a load is applied, a straight line is obtained from S to A. A heavy load is applied from A, the driving source receives a large resistance, so that deformation occurs and displacement is delayed in time around a part of the press forming machine where a load is applied, resulting in a relatively larger distance from the fixed mold than the other parts. Thus, travelling is delayed by ΔZb from an average traveling line per elapsed time. The delay in displacement is measured by the displacement measuring means 50*b* near the above part of the slide plate, and a measured value is transmitted to the control means 92. The control means 92 transmits driving pulse signals to the driving source 60*b* more than to the other driving sources such that the slide plate returns to a desired displacement. The above operation is repeated so as to have the same displacement as the other parts at, for example, position B.

After the position B of FIG. 4, a load applied on the driving source 60*b* is reduced. Hence, traveling is faster by ΔZb from the average traveling line per elapsed time. Thus, the control means 92 transmits fewer driving pulse signals to the driving source 60*b* such that the slide plate has a desired displacement. Such adjustment is repeated until the molding end F. Since the same control is exercised on the other driving sources, molding can be performed while the slide plate is entirely maintained at a desired displacement position. As a result, it is possible to prevent the occurrence of rotation moment on the slide plate during molding.

Such a driving pulse signal is shown in TABLE 1. Time fields of TABLE 1 correspond to molding times of FIG. 4, and a predetermined pulse indicates an average number of pulses required in each molding time period. Thus, the driving source 60*b* receives n0 driving pulse and travels to A from time 0 to tA. The other driving sources travel in the same manner. The driving source 60*b* receives nA driving pulse signals from time tA to tB, and delay of ΔZb appears in each predetermined time period. Thus, it is necessary to additionally receive a driving pulse signal of ΔnAb. And then, regarding the driving source 60*b* from tB to tC, the number of pulses can be smaller than a predetermined amount of pulse nB by ΔnBb. Further, from tC to tF, the number of pulses needs to be larger than a predetermined amount nC by ΔnCb.

TABLE 1

| TIME | PREDETERMINED PULSE NUMBER | DRIVING SOURCE 60a | DRIVING SOURCE 60b | . . . | DRIVING SOURCE 60e |
|---|---|---|---|---|---|
| 0 to tA | n0 | n0 | n0 | . . . | n0 |
| tA to tB | nA | nA − ΔnAa | nA + ΔnAb | . . . | nA + ΔnAe |
| tB to tC | nB | nB − ΔnBa | nB − ΔnBb | . . . | nB + ΔnBe |
| tC to tF | nC | nC + ΔnCa | nC + ΔnCb | . . . | nC − ΔnCe |

As described above, in such an initial or a plurality of times of trial molding, a displacement of the driving source (or a part of the slide plate near the engaged driving source) is measured by the displacement measuring means corresponding to the driving source in each operating step, and driving pulse signals supplied to the driving sources are controlled to maintain values measured by the displacement measuring means at desired displacement positions. During the trial work molding, driving pulse signals supplied to the driving sources are stored in the memory as a control data table in each operating step. Thus, the control data table shown in TABLE 1 is stored.

Figures 5A, 5B, 5C, 5D:
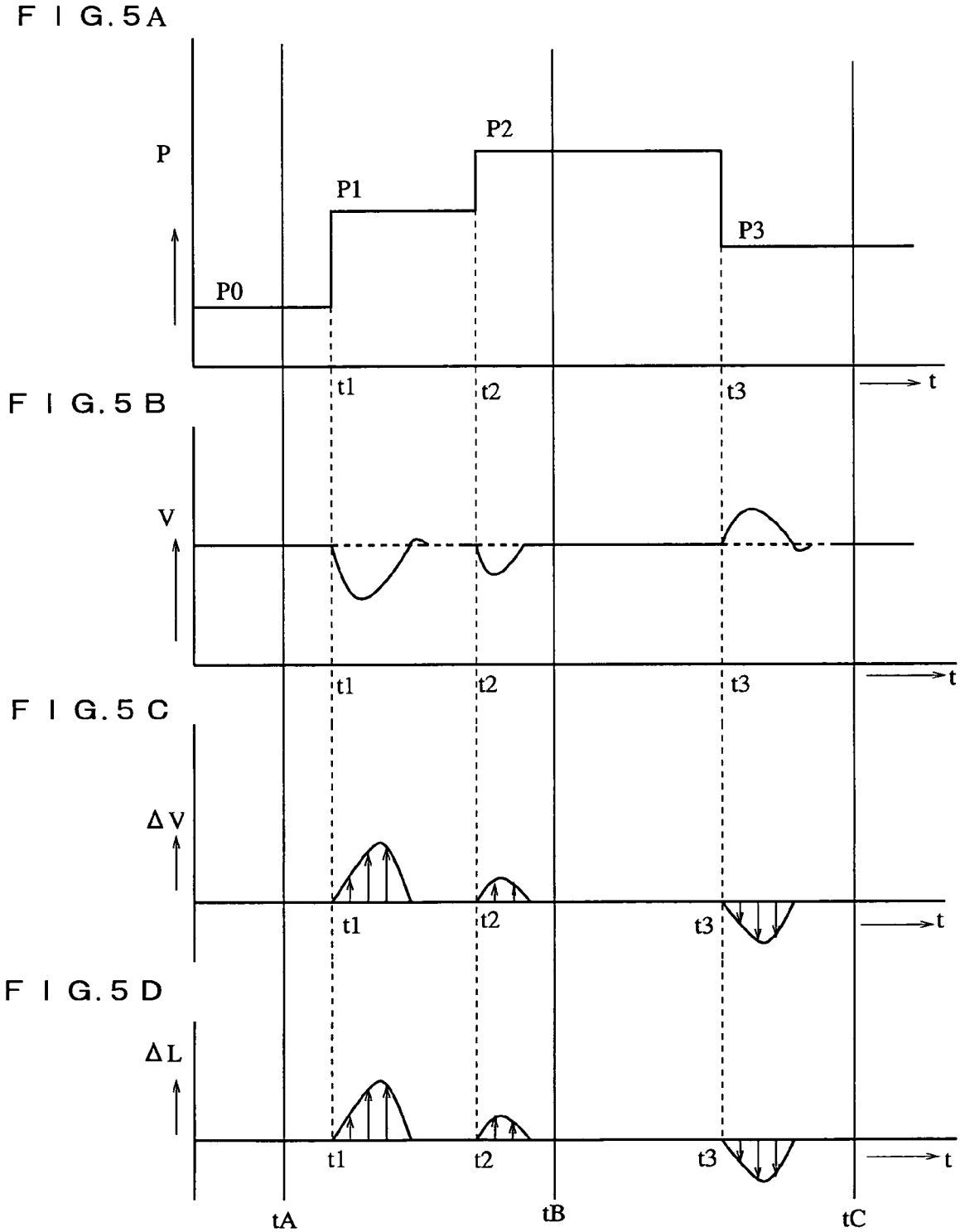
FIGS. 5(A), 5(B), 5(C), and 5(D) are graphs showing that a load applied to a driving source is changed while molding is performed by the driving source and a lateral axis indicates time.

Basically, the above control is sufficient. However, it is found that a problem of FIG. 5 actually occurs in the case of more precise control. FIG. 5 shows that a load applied to the driving source is changed while molding is performed by the driving source and a lateral axis indicates time. FIG. 5(A) shows a change in load P, and FIG. 5(B) shows a change in descending speed caused by delay in control exercised on the driving source. Even when a driving amount supplied to the driving sources is controlled so that the slide plate has a desired displacement 1 at timing shown in FIG. 4, the timing being divided for the steps of the forming operation, timing t1, t2, . . . having a change in load P of FIG. 5(A) do not generally conform to timing tA, tB, tC, and tF of FIG. 4. Thus, the above-mentioned undesirable change in speed and position cannot be eliminated merely by selecting small intervals between timing tA and tB, between timing tB and tC, and between timing tC and tF to perform precise control.

Hence, it is desirable to measure a positional displacement on each of the driving sources, the positional displacement corresponding to a change in load on each of the driving sources, and the following correction is desirable: as shown in FIG. 5, a driving amount for the driving source 60*b* is made larger than the original amount discussed in FIG. 4 for a predetermined period before and after timing t1 where a load is changed, a driving amount for the driving source 60*b* is similarly made larger for the predetermined period before and after timing t2, and a driving amount is made smaller in a like manner for the predetermined period before and after timing t3. FIG. 5(C) shows a required amount of speed correction for correcting a change in speed of FIG. 5(B). FIG. 5(D) shows a position correcting required amount for correcting a positional change resulted from a change in speed of FIG. 5(B). In reality, it is sufficient to correct one of the speed correcting required amount of FIG. 5(C) and the position correcting required amount of FIG. 5(D).

In view of the above points, during the above trial operation, timing t1, t2, t3, . . . , are detected on which load P changes as shown in FIG. 5(A), and for a predetermined period from the moment slightly before timing t1 or from timing t1, a driving amount larger than the original amount discussed in FIG. 4 (e.g., the number of driving pulses is increased) or a driving amount smaller than the original amount (e.g., the number of driving pulses is reduced) is applied to, for example, the driving source 60*b*. In each of the operating steps of the molding operation, a correction amount for a driving amount to be supplied to the driving sources and timing to supply the correction amount are included in the control data table and are stored in the memory. Additionally, as a method for increasing or reducing a driving amount, a pulse interval of a driving pulse may be changed, or the number of pulses supplied by means (not shown) may be increased or reduced. In this manner, it is possible to eliminate an error resulted from control delay which was discussed in FIG. 5.

When a work piece is molded in a press forming machine, the same kind of work pieces are normally molded in a repeated manner. Thus, during the actual molding for the same kind of work pieces, the kind of work pieces are specified by the input means 91 and so on to call up the content of the control data table, which is stored in the memory. The control means 92 activates the driving sources 60*a* to 60*e* according to the content of the control data table via the interface 94, so that the work pieces can be molded while the slide plate is maintained at a desired displacement position.

When the same kind of work pieces are molded repeatedly, the cycle time can be shorter than that of the trial work molding for forming the control data table. For example, 10 seconds of cycle time of the trial work molding can be gradually shortened to, for example, an extremely short cycle time of one second in the actual molding after several trials. The cycle time is shortened by reducing the time interval of the driving pulse, eliminating the interval between an operating step and the subsequent step, or performing direct control using control data.

When the control data table is formed by the trial work molding, it is preferable that the driving sources are moved as slowly as possible to slowly move the slide plate and the movable mold. Since impact during molding causes vibration or a load during molding causes deformation on the press forming machine to produce vibration, driving is preferably performed after time for reducing the vibration within a permissible range. The delay can maintain and improve the accuracy of displacements measured by the displacement measuring means. Moreover, as the CPU included in the control means, a CPU with a relatively slow processing speed is also applicable for producing the control data.

In the actual work molding according to the control data table, it is preferable to shorten the cycle time. Thus, during trial molding, the time intervals of the driving pulses are successively reduced to shorten the cycle time. In trial molding which successively use shorter driving pulses, it is confirmed that the slide plate is maintained at a desired position by the displacement measuring means. The number of driving pulses is adjusted and corrected as necessary to remake the control data table of TABLE 1.

The control data table is formed with a shorter cycle time after several times of trial molding. Thus, by performing actual molding according to the corrected control data table, molding can be performed in a short time while the movable mold and the fixed mold are maintained at desired positions. In the actual molding, the driving sources are operated by control data, so that it is not necessary to use all the displacement measuring means for measurement. At some positions having the displacement measuring means, interference with a work handling operation may occur in an actual operation. Thus, before a pressing operation, it is also possible to remove the displacement measuring means that may cause the interference.

Further, the dimension of the press forming machine may be affected by a temperature increased by an ambient temperature and heat liberation of the press forming machine. Thus, in the case of repeated molding, trial molding is performed at least once every day or in each of several hundreds times of molding, and in the trial molding, the content of the control data table can be confirmed or corrected while the position of the slide plate is measured by the displacement measuring means.

The above explanation mainly discussed that the movable mold stays horizontal to the fixed mold. Some kinds of work piece and press forming machine may require diagonal molds. Thus, "a desired displacement position" is used.

In the above description, in the trial press forming, a driving amount, for example, the number of control pulse signals is extracted such that the slide plate, that is, the movable mold maintains a desired position relative to the fixed mold in each of a plurality of operating steps of the progress of molding, the driving amount is stored as a control data table in the memory, and the driving sources are driven according to the control data table during the actual molding. The concept of the present invention can be changed as follows: for example, when a plurality of similar press forming machines are provided and the same type of product is molded by the same type of mold, trial molding is performed by one of the press forming machines to produce a control data table. And then, the control data table is used by another press forming machine among the above-mentioned press forming machines to perform actual molding. In another case, a control data table is obtained by virtual press forming using a data processing system and so on, and then, the control data table is used for an actual press forming machine to perform molding.

Besides, in the press forming machine shown in FIGS. 1 and 2, the displacement measuring means 50*a* to 50*e* are provided near the driving sources 60*a* to 60*e* to measure a displacement relative to the reference plate 70. Only the displacement measuring means 50*j* can measure a displacement of the slide plate 40 relative to the lower support stand 10. When the columns 20 has small or little extension during molding, it is only necessary to measure a displacement position relative to the reference plate 70 attached to the columns 20.

Figure 6:
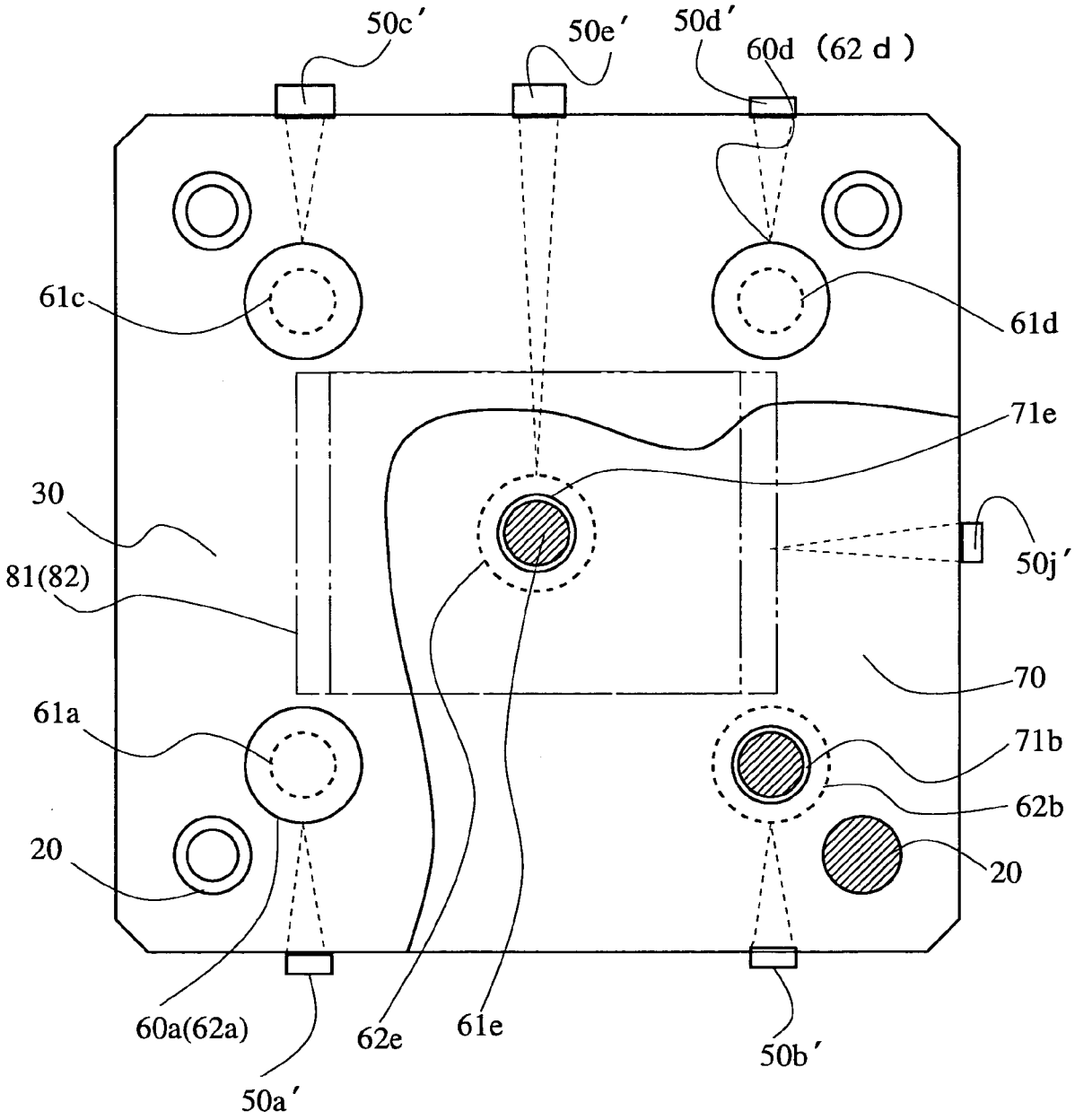
FIG. 6 is a plan view showing that displacement measuring means are changed in the press forming machine of FIG. 1.

However, when a displacement needs to be measured more accurately or in order to avoid an error caused by the extension of the columns 20, as shown in FIG. 6, it is more preferable to optically measure a position while the displacement measuring means 50*a*' to 50*e*' and 50*j*' are provided outside the press forming machine.

Figure 7:
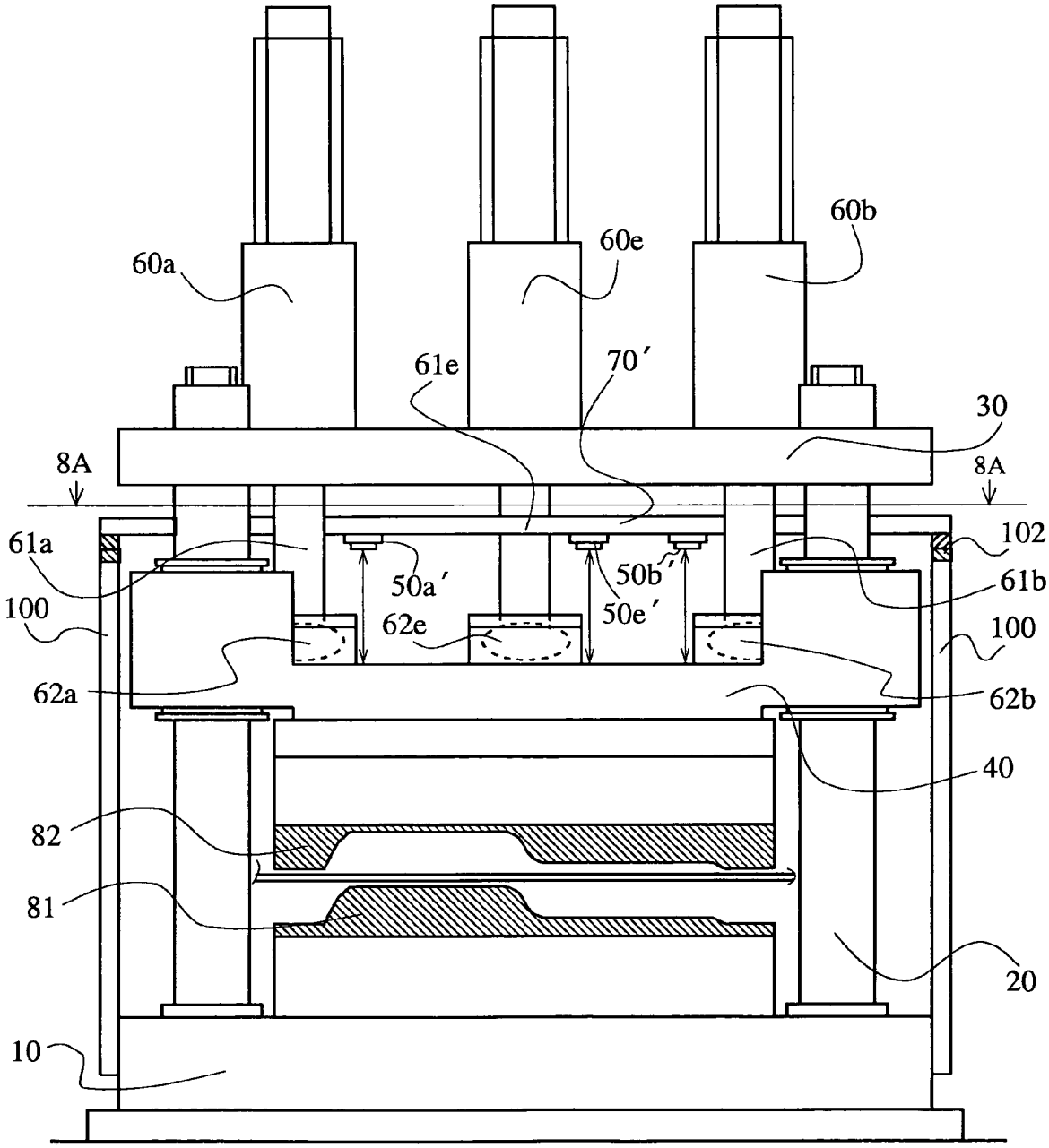
FIG. 7 is a front view showing a press forming machine of another example.
Figure 8A:
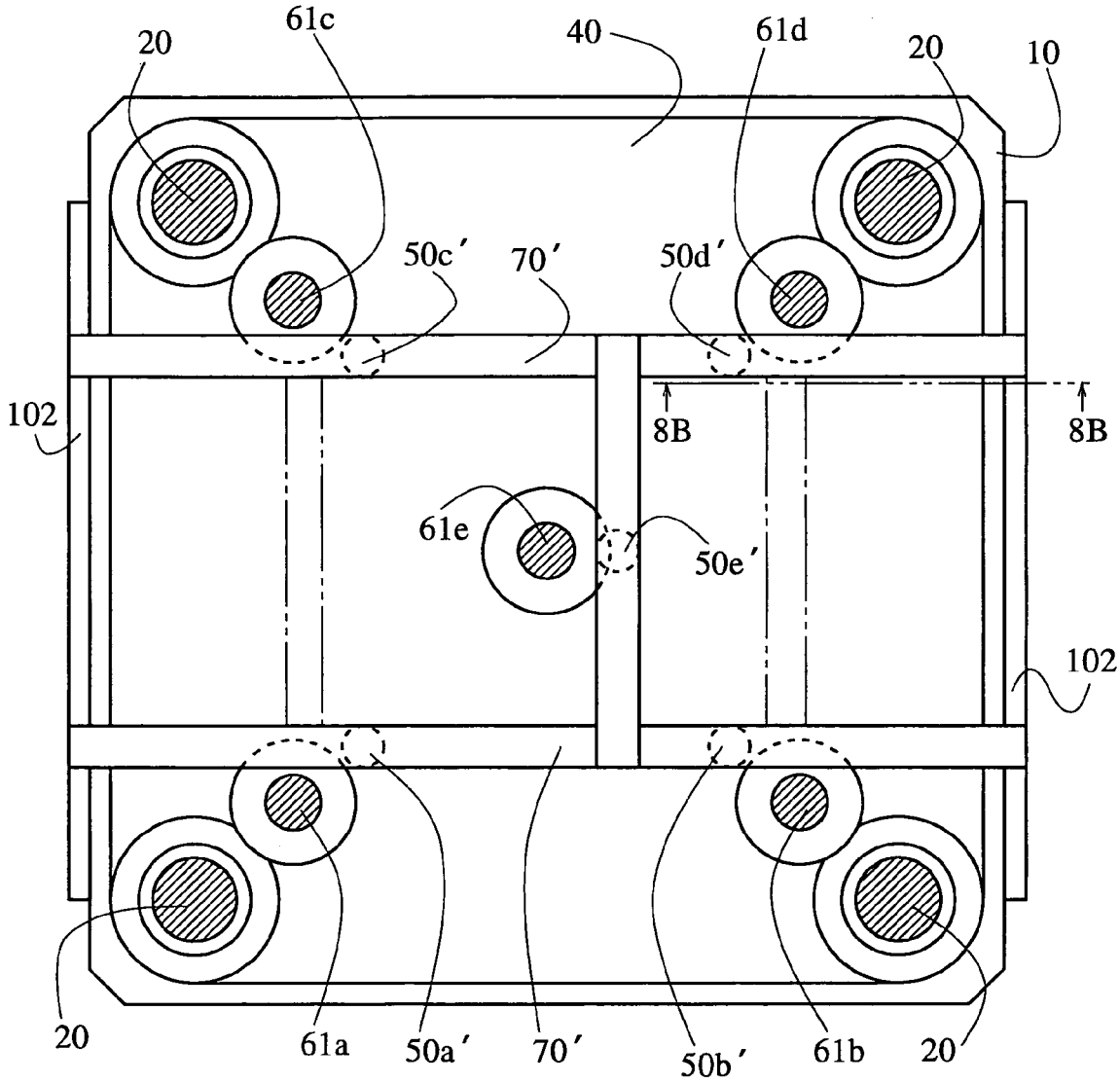
FIG. 8(A) is a plan view showing the press forming machine taken along line 8A—8A of FIG. 7.
Figure 8B:
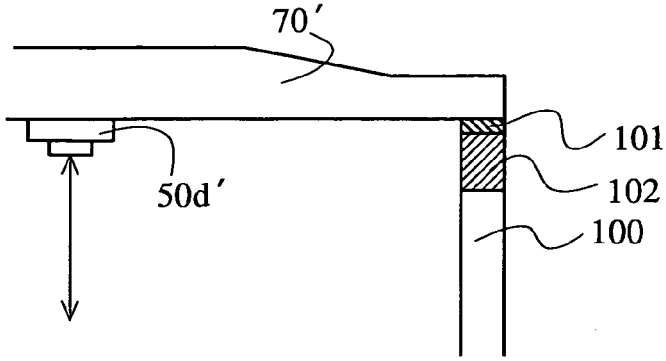
FIG. 8(B) is a side view showing the reference plate taken along line 8B—8B of FIG. 8(A)

FIGS. 7 and 8 show a variation of the press forming machine shown in FIGS. 1 and 2. FIG. 7 is a front view of the press forming machine. FIG. 8(A) is a plan view of the press forming machine taken along line 8A—8A of FIG. 7. FIG. 8(B) is a side view of a reference plate taken along line 8B—8B of FIG. 8(A).

In the press forming machine of FIGS. 1 and 2, the reference plate 70 is provided under the upper support plate 30 via a gap and is fixed over the columns 20, and the through-holes 71*a*, 71*b*, . . . , 71*e* with sufficient diameters are provided on parts having the drive shafts 61*a*, 61*b*, . . . , 61*e*. Thus, the reference plate is not affected by deformation on the drive shafts and the slide plate. However, it is more preferable that even slight deformation on the upper support plate 30 does not affect the reference plate 70 at all.

In order to solve the above problem, in FIGS. 7 and 8, a reference plate 70' is held and fixed by the lower support stand 10. Besides, in FIG. 7, the detail including displacement measuring means 50*a*', 50*b*' and . . . 50*e*' is omitted. For example, as shown in FIG. 8(B), measuring means using light beam is adopted.

As shown in FIG. 8(A), the reference plate 70' is formed into a shape not interfering with drive shafts 61*a*, 61*b*, 61*c*, 61*d* and 61*e* and columns 20. For example, the reference plate 70' is formed as an H-shaped frame made of titanium. Further, the above-mentioned displacement measuring means 50*a*', 50*b*' are attached to the frame. As shown in FIG. 7 and FIG. 8(A), the reference plate 70' is supported and fixed by detection columns 100 and connecting bars 102 on the lower support stand 10. As shown in FIGS. 8(A) and 8(B), the reference plate 70' is preferably attached via vibration-isolating plates 101 on the connecting bars 102 supported by the detection columns 100. Additionally, it is preferable to use a material such as invar, which is less susceptible to heat, for the detection columns 100 and connecting bars 102. With the above configuration, the reference plate 70' is supported and fixed on the lower support stand 10 and is completely independent from deformation on the upper support plate 30.

INDUSTRIAL APPLICABILITY

As specifically discussed above, according to the press forming machine of the present invention, the movable mold can be always maintained at a desired position relative to the fixed mold during press forming, and rotation moment can be prevented during molding. Furthermore, molding time can be shortened in the case of repeated molding.

The invention claimed is:

1. A press forming machine, comprising:

a lower support stand;

a plurality of columns supported by said lower support stand;

an upper support plate held by said plurality of columns;

a slide plate, said slide plate reciprocating between said lower support stand and said upper support plate and has a molding space defined between said slide plate and said lower support stand;

a plurality of servo motors, said servo motors having drive shafts engaged to an upper surface of said slide plate to make a displacement on said slide plate;

control means for controlling driving of each of said servo motors;

engaging parts, said engaging parts are engaged to an upper surface of said slide plate and provided on said slide plate so as to correspond to said servo motors, said servo motors each having a drive shaft for pressing the engaging part to make a displacement on said slide plate;

displacement measuring means for measuring a displacement according to a positional displacement of said slide plate, said displacement measuring means being disposed near each of said engaging parts;

said control means comprising:

means which measure a positional displacement of each of said motor servos by using a displacement measuring means in each of a plurality of operating steps during the molding operation in which a load from a workpiece acts on the slide plate, measures a positional displacement for each of said servo motors, the positional displacement corresponding to a change in load on each of said servo motors, detects a desired displacement position of the entire slide plate, extracts control data corresponding to said servo motors to maintain the entire slide plate at the desired displacement position, stores the control data in memory; and supplies the control data to said servo motors, and separately driving said servo motors.

2. A press forming machine in accordance with claim 1, wherein a correction amount is supplied when a load on each of said servo motors is changed or for a predetermined period from when a load is changed.

3. A press forming machine in accordance with claim 1, wherein said control means comprising means which supplies to said servo motors control data corresponding to said servo motors in each of a plurality of operating steps during an actual molding operation and which separately drives said servo motors, the control data being obtained so as to maintain the entire slide plate in a desired position in each of a plurality of operating steps during a trial molding operation.

4. A press forming machine in accordance with claim 1, wherein said displacement measuring means measures a displacement between the slide plate and a reference plate supported and fixed on the lower support stand.

5. A press forming machine in accordance with claim 1, wherein said plurality of said servo motors is arranged such that pressure of the plurality of said servo motors is distributed on the slide plate.

6. A press forming machine in accordance with claim 5, wherein said plurality of said servo motors cause equal pressure relative to each other per control data.

7. A press forming machine comprising:

a base;

a plurality of columns extending from said base;

a support plate connected to said plurality of columns and arranged spaced from said base;

a slide plate slidably mounted on said plurality of columns;

a plurality of driving sources connected to said slide plate and moving said slide plate on said plurality of columns;

engaging parts, said engaging parts are engaged to an upper surface of said slide plate and provided on said slide plate so as to correspond to said servo motors, said servo motors each having a drive shaft for pressing the engaging part to make a displacement on said slide plate;

displacement measuring means for measuring a displacement according to a positional displacement of said slide plate, said displacement measuring means being disposed near each of said engaging parts; and a control unit operating said plurality of driving sources to move said slide plate, and dividing the moving of said slide plate into a plurality of trial steps while a pilot piece is applying an uneven force to said slide plate, said control unit including a memory storing control data providing displacement instructions for each of said plurality of driving sources and for each of said plurality of trial steps, said control unit operating said plurality of driving sources in a plurality of workpiece steps corresponding to said trial steps based on said displacement instructions during actual molding of a workpiece.

8. A press forming machine in accordance with claim 7, wherein:

the workpiece is placed in between said slide plate and said base, the workpiece applying an uneven force and time varying force to said slide plate as said slide plate moves toward said base;

said displacement instructions compensate for said time varying force and maintain said slide plate at a predetermined position with respect to said base during each of said workpiece steps when said slide plate moves toward said base.

9. A press forming machine in accordance with claim 8, wherein said displacement instructions are predetermined from movements of said slide plate pressing previous workpieces.

10. A press forming machine in accordance with claim 7, wherein said displacement measuring means measures a displacement between the slide plate and a reference plate supported and fixed on the lower support stand.

11. A press forming machine comprising:

a lower support stand;

an upper support plate held by a plurality of columns supported by the lower support stand;

a slide plate which can reciprocate between the lower support stand and the upper support plate and has a molding space between the slide plate and the lower support stand;

a plurality of servo motors, said servo motors having drive shafts engaged to an upper surface of the slide plate to make a displacement on the slide plate;

control means for controlling driving of each of the servo motors; and displacement measuring means which is disposed near each of parts of said slide plate engaging each of said drive shafts;

said control means comprising: a control data extracting means, a memory and a driving means, wherein, during a molding operation in which a load from a workpiece acts on the slide plate, the control data extracting means measures a displacement of the slide plate for each of the servo motors by the displacement measuring means during each of a plurality of operating steps that the molding operation is divided into, extracts a control data based on the measured displacement for each of the servo motors and for each of the plurality of operating steps of the molding operation to maintain the entire slide plate at a desired displacement position during the operating step, and stores the control data in the memory;

wherein the memory stores the control data for each of the servo motors and for each of the plurality of operating steps, the control data providing a displacement of each of the servo motors; and wherein, when a molding operation is performed in which the load from a workpiece acts on the slide plate, the driving means supplies to each of the servo motors the control data stored in the memory for each of the servo motors and for each of a plurality of operating steps that the performed molding operation is divided into and separately drives the servo motors during each of the plurality of operating steps of the performed molding operation.

12. A press forming machine in accordance with claim 11, wherein said control data extracting means extracts the control data based on the measured displacement for each of the servo motors and for each of the plurality of operating steps to maintain the entire slide plate in a horizontal position during an operating step, and stores the control data in memory.

13. A press forming machine in accordance with claim 11, wherein, during a trail molding operation in which a load from a workpiece acts on said slide plate, said control data extracting means measures a displacement of said slide plate for each of said servo motors by said displacement measuring means during each of a plurality of operating steps that the trail molding operation is divided into, extracts a control data based on the measured displacement for each of said servo motors and for each of the plurality of operating steps of the trial molding operation to maintain the entire slide plate a desired displacement position during the operating step of the trail molding operation and stores the control data in the memory; and when an actual molding operation is performed in which the load from a workpiece acts on said slide plate, the driving means supplies to each of said servo motors the control data stored in the memory for the servo motor and for each of a plurality of operating steps that the actual molding operation is divided into and separately drives said servo motors during each of the plurality of operating steps of the actual molding operation.

14. A press forming machine in accordance with claim 13, wherein the control data extracting means extracts the control data based on the measured displacement for each of said servo motors and for each of the plurality of operating steps of the trial molding operation to maintain the entire slide plate in a horizontal position during the operating step of the trial molding operation, and stores the control data in memory.

15. A press forming machine in accordance with claim 11, wherein said displacement measuring means measures a displacement between the slide plate and a reference plate supported and fixed on the lower support stand.

* * * * *